US008590197B1

(12) United States Patent
Sylvester

(10) Patent No.: US 8,590,197 B1
(45) Date of Patent: Nov. 26, 2013

(54) FIREARM CONVERSION ASSEMBLY AND METHOD

(75) Inventor: Dean Sylvester, Boise, ID (US)

(73) Assignee: Primary Weapons, Boise, ID (US)

( * ) Notice: Subject to any disclaimer, the term of this patent is extended or adjusted under 35 U.S.C. 154(b) by 22 days.

(21) Appl. No.: 13/463,191

(22) Filed: May 3, 2012

Related U.S. Application Data

(60) Provisional application No. 61/482,395, filed on May 4, 2011.

(51) Int. Cl.
*F41A 3/12* (2006.01)
*F41A 3/72* (2006.01)

(52) U.S. Cl.
USPC ..... 42/16; 42/16.1

(58) Field of Classification Search
USPC ..... 42/16, 16.1; 89/128
See application file for complete search history.

(56) References Cited

U.S. PATENT DOCUMENTS

| | | | | | |
|---|---|---|---|---|---|
| 3,221,603 | A * | 12/1965 | Lochhead | 89/33.2 |
| 3,559,940 | A * | 2/1971 | Kruzell | 42/127 |
| 3,745,682 | A * | 7/1973 | Waldeisen | 42/106 |
| 4,295,410 | A * | 10/1981 | Patenaude et al. | 89/12 |
| 4,672,762 | A * | 6/1987 | Nilsson | 42/70.01 |
| 4,920,855 | A * | 5/1990 | Waters | 89/172 |
| 6,131,324 | A | 10/2000 | Jewell | |
| 7,302,881 | B1 | 12/2007 | Tertin | |
| 8,117,954 | B1 * | 2/2012 | Davis | 89/1.4 |
| 2004/0069137 | A1 * | 4/2004 | Jebsen et al. | 89/198 |
| 2005/0188577 | A1 * | 9/2005 | Popikow | 42/16 |
| 2011/0061523 | A1 * | 3/2011 | Webb | 89/128 |
| 2011/0209607 | A1 * | 9/2011 | St. George | 89/191.01 |
| 2012/0102803 | A1 * | 5/2012 | Troy et al. | 42/71.01 |

OTHER PUBLICATIONS

Exploded View (of 10/22 carbine rifle), Published on the internet at: http://www.ruger.com/products/1022Carbine/extras.html, "Exploded View," 2013, Sturm, Ruger, & Co., Inc., All.*

Instruction Manual (10/22 Carbine Rifle), Published on the internet at: http://www.ruger.com/products/1022Carbine/extras.html, "Instruction Manual," 2013, Sturm, Ruger, & Co., Inc., Ali.*

* cited by examiner

*Primary Examiner* — Bret Hayes
(74) *Attorney, Agent, or Firm* — Dwayne E. Rogge; Schacht Law Office, Inc.

(57) ABSTRACT

The disclosed apparatus and method facilitates modification of a firearm, such as an automatic, semi-automatic, bolt action, or other firearm to be modified to a scissor-style bolt action firearm. In one embodiment the firearm is a semi-automatic firearm prior to modification. In one particular embodiment, the firearm is a rifle sold by the Ruger company under the model name 10/22.

6 Claims, 6 Drawing Sheets

FIREARM CONVERSION ASSEMBLY AND METHOD

RELATED APPLICATIONS

This application claims priority benefit of U.S. Ser. No. 61/482,395 filed May 4, 2011 incorporated herein by reference.

BACKGROUND OF THE DISCLOSURE

Field of the Disclosure

This disclosure relates to the field of firearm actions and associated components. In particular, this disclosure relates to the field of actions and associated components for a firearm known as a Ruger 10/22.

SUMMARY OF THE DISCLOSURE

Disclosed herein is a retrofit assembly for a rifle. The retrofit assembly comprising: modified bolt having at least one stud extending upwards therefrom; a front lever pivotably attached at a forward end to the modified bolt; a rear lever having a forward end pivotably attached to a rear portion of the front lever; a toggle handle fixedly coupled to the rear lever; the rear lever having pivotably coupled to a rearward end of a top rail; the top rail having a plurality of attachment points to facilitate attachment to a receiver of the rifle; and the top rail further comprising at least one surface defining a channel guide for linear repositioning of the stud therein.

The retrofit assembly as disclosed above may be arranged wherein the rifle is a rifle sold by the Ruger company under the model name 10/22.

The retrofit assembly may specifically be arranged wherein the receiver is a stock receiver which has been modified to accept the attachment points of the top rail.

The retrofit assembly as disclosed has the advantage that upon firing of a cartridge, the bolt remains stationary until the toggle handle is manually actuated. Normally this is accomplished by the person shooting.

A method for retrofitting a rifle to a scissor-style bolt action is also disclosed. The method comprising the steps of: removing the bolt of the rifle;

replacing the bolt with a modified bolt having at least one stud extending upwards therefrom; pivotably attaching a forward end of a front lever to the modified bolt; pivotably attaching a forward end of a rear lever to a rear portion of the front lever; fixedly coupling a toggle handle to the rear lever; pivotably coupling a rearward end of the rear lever to a rearward end of a top rail; attaching the top rail to a receiver of the rifle; and wherein the top rail further comprises at least one surface defining a channel guide for linear repositioning of the stud therein.

The method for retrofitting a rifle to a scissor-style bolt action is particularly suited wherein the rifle is a rifle sold by the Ruger company under the model name 10/22.

DESCRIPTION OF THE PREFERRED EMBODIMENTS

Before beginning a detailed description, an axes system 10 is disclosed comprising a longitudinal axis 12, a vertical axis 14, and a transverse axis 16. These axes are to be used to assist in explanation, and are not intended to limit the disclosure to any particular orientation.

The term "10-22" for this disclosure is defined as the rifle manufactured by Ruger® at the time of invention. Similarly, the term "10-22 action" for this disclosure is defined as the action manufactured by Ruger® for the 10-22 rifle at the time of invention.

Figure 1:
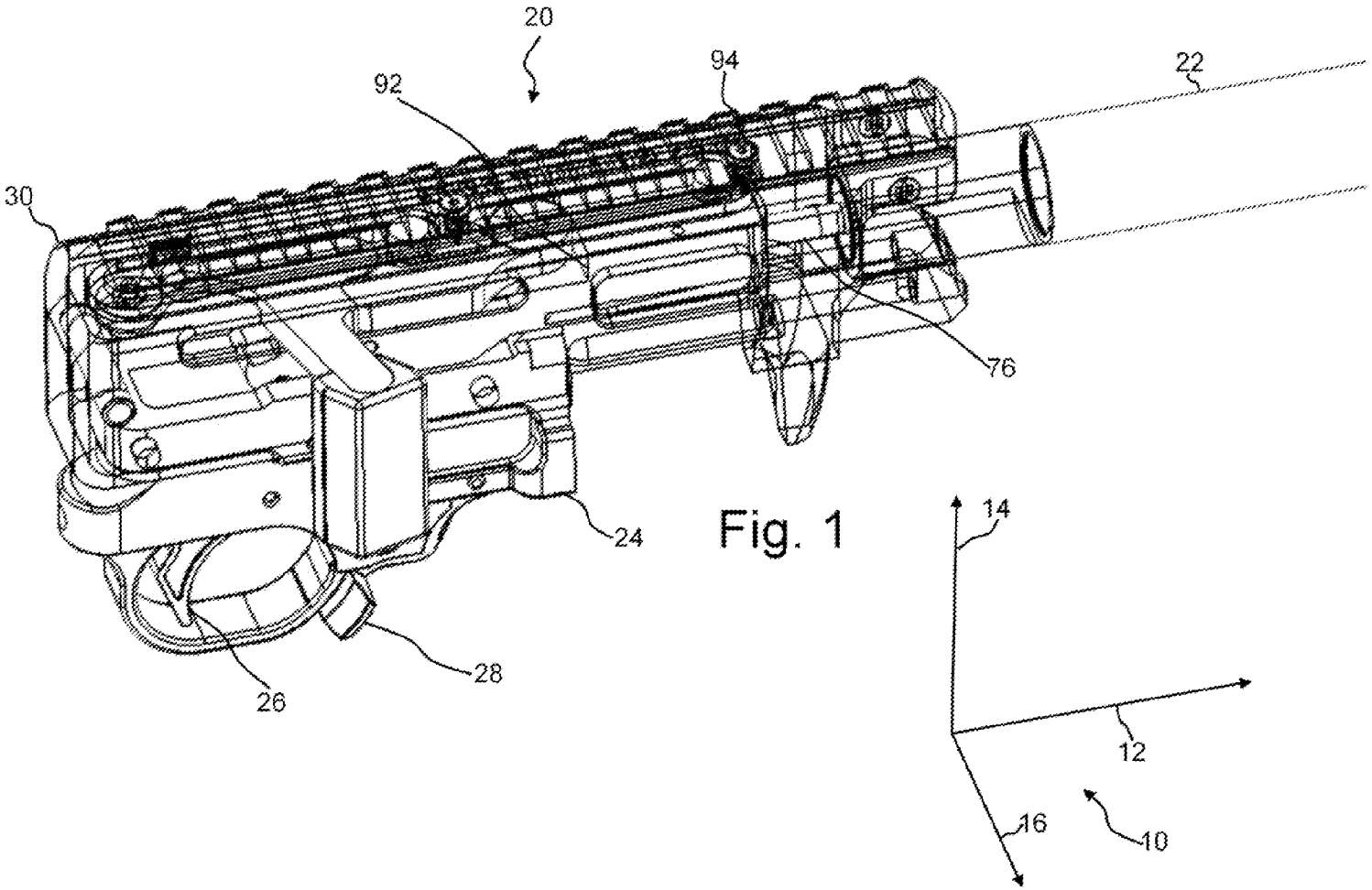
FIG. 1 is an isometric view of portions of a firearm according to one embodiment of the disclosure.

Looking to FIG. 1, a Ruger 10/22 conversion unit 20 is shown for use in a stock Ruger 10/22 trigger housing and barrel. The remaining, not shown portions of a stock Ruger 10/22 would not be adapted.

The unit 20 shown in FIG. 1 utilizes a stock trigger housing 24 and several other stock components. Also shown is a trigger 26 and magazine (mag) release 28. The mag release 28 shown is not novel to this disclosure. In the remainder of the Figs., the barrel 22 has been removed to more adequately show the remaining components. Many of these components can be seen partially through the semi-transparent receiver 30 shown in FIG. 1. This receiver 30 would not normally be made of a transparent material.

Figure 2:
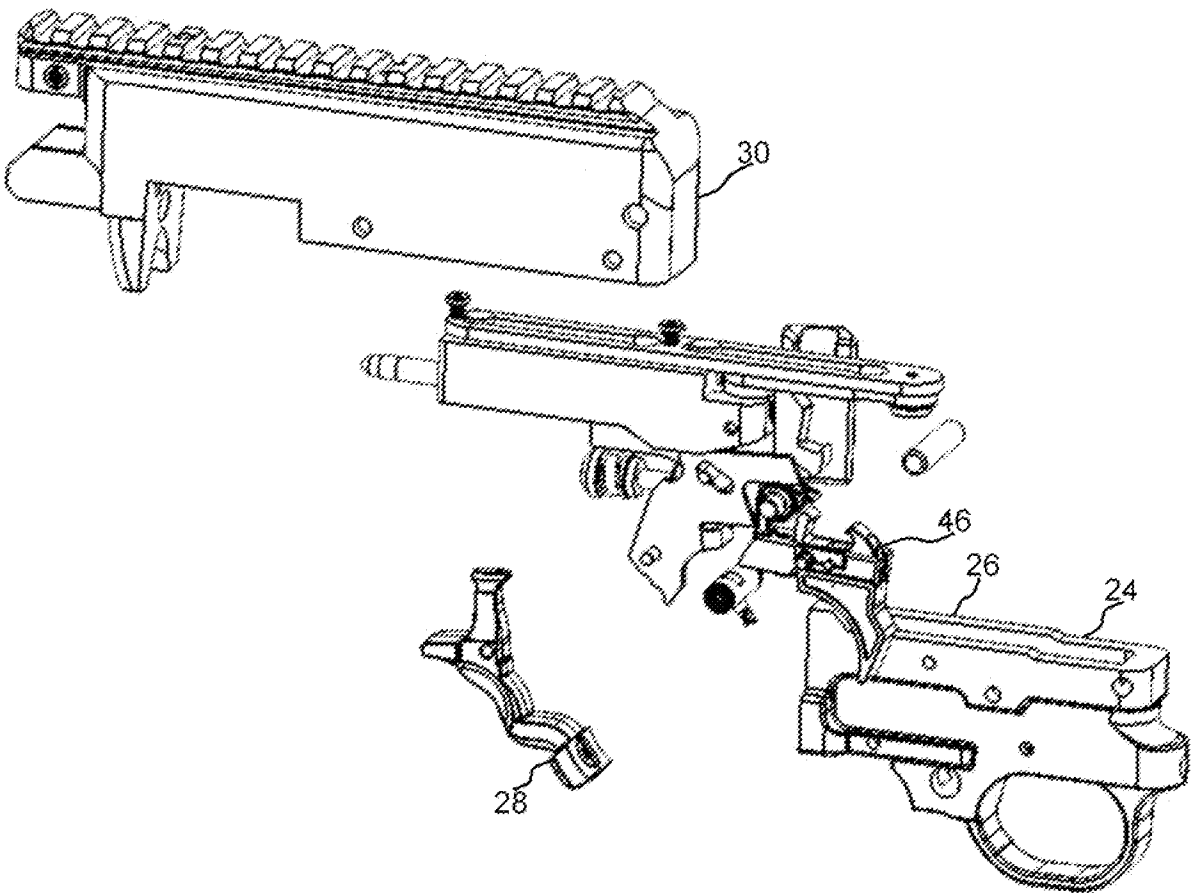
FIG. 2 is an exploded view of the embodiment of FIG. 1 with several components removed to show the underlying components with several components removed to show the underlying components.

Looking to FIG. 2, an exploded view is shown comprising the receiver 30, main body, trigger housing 24, magazine (mag) release 28 and other components.

Figure 3:
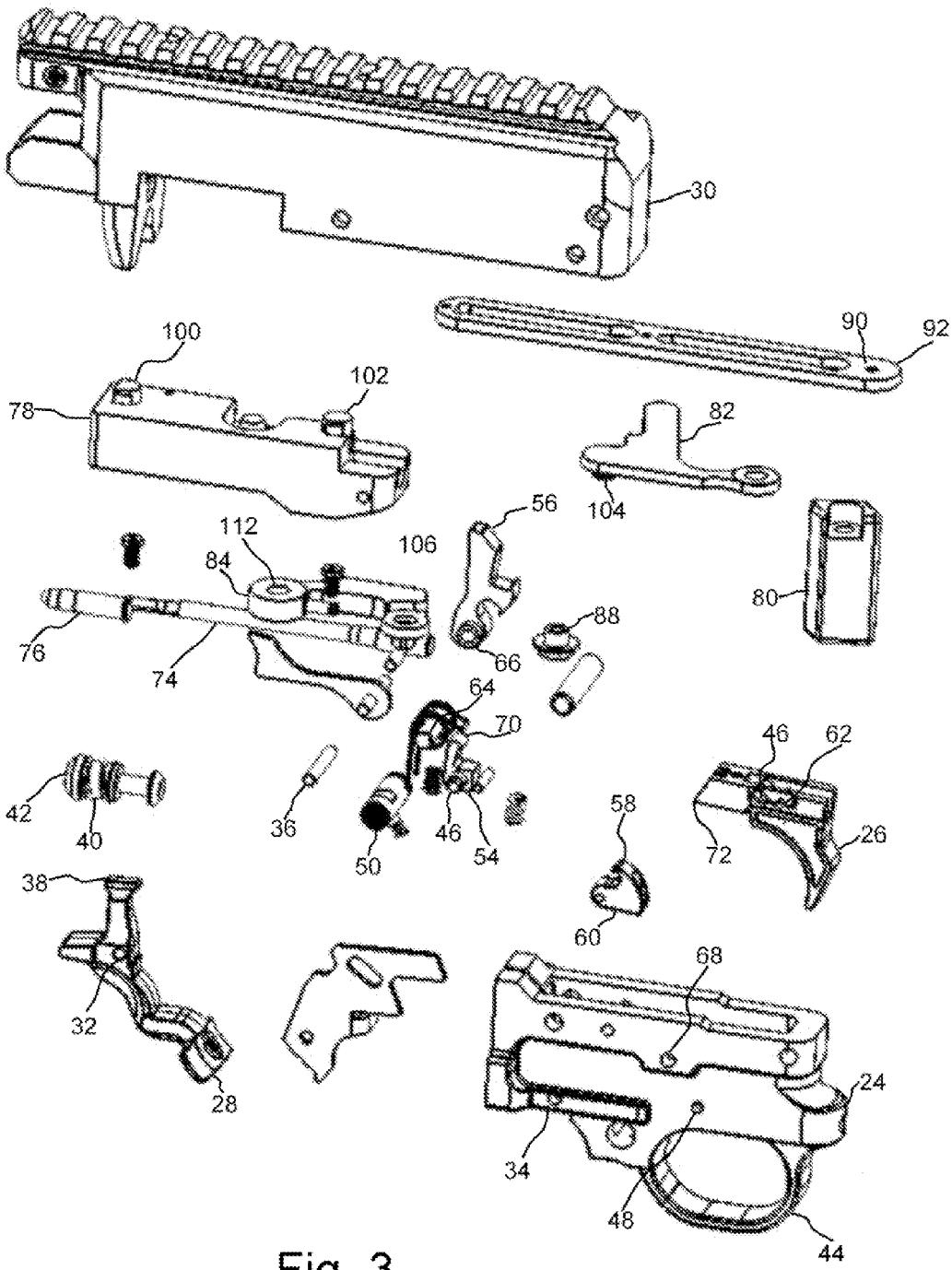
FIG. 3 is an exploded view of the embodiment of FIG. 1 with several components removed to show the underlying components.

These components are also shown in FIG. 3, which is an additional exploded view. The mag release 28 fits within the trigger housing 24 and pivots about pivot location 32. The pivot location 32 aligns with pivot location 34 on the trigger housing and pin 36 passes therethrough to allow the mag release 28 to pivot when depressed. The upper edge 38 of the mag release engages the magazine catch 40, which has a forward surface 42 that engages the magazine and holds it within the magazine well of the receiver 30. A spring is shown which repositions the magazine catch 40 towards the magazine unless repositioned by pivoting of the mag release 28.

The trigger 26 also fits within the trigger housing 24 and is partially protected by the trigger guard 44. The trigger 26 pivots about pivot 46 (see FIG. 2), which is generally a pin that passes through the surface defining the void 48 in the trigger housing 24. When the safety 50 is released, the trigger 26 is allowed to rotate or pivot. The trigger 26 is also coupled through the pin 46 to a first seer 54, which engages the hammer 56. A second seer 58 is also coupled to the trigger 26 through a pivot 60, utilizing another pin that passes through voids 62. The second seer 58 also engages the hammer 56. Hammer 56 rotates about pin 64, which passes through voids 66 in the hammer 56 and void 68 in the trigger housing 24. A spring 70 engages the forward portion 72 of the trigger 26, as well as the hammer 56, to reposition the hammer 56 upward/ forward when released by the seers 54 and 58 to engage the rear portion of a firing pin 74, repositioning it forward to engage the edge portion of a rifle cartridge 76. In one form, the cartridge is a rim fire, 0.22 caliber long rifle cartridge.

In a standard Ruger 10/22, firing of the cartridge 76 would reposition the bolt 78, firing pin 74, and hammer 56 rearward/downward, whereupon the following cartridge would be repositioned from the magazine into the firing location shown in FIG. 1, whereupon activation of the trigger 26 again would fire this new cartridge.

Figure 4:
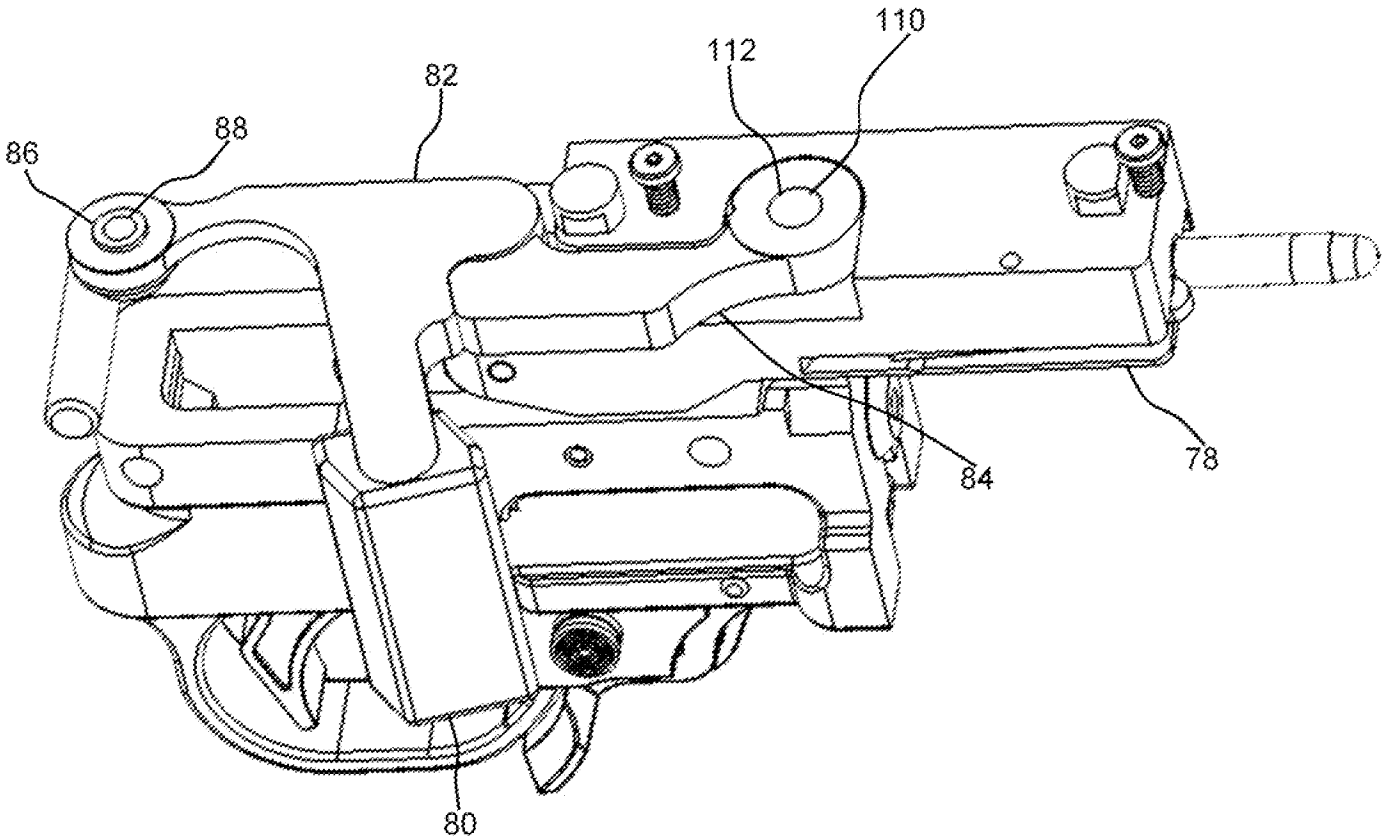
FIG. 4 is a detail view of several internal components of the embodiment of FIG. 1 with several components removed to show the underlying components.
Figure 5:
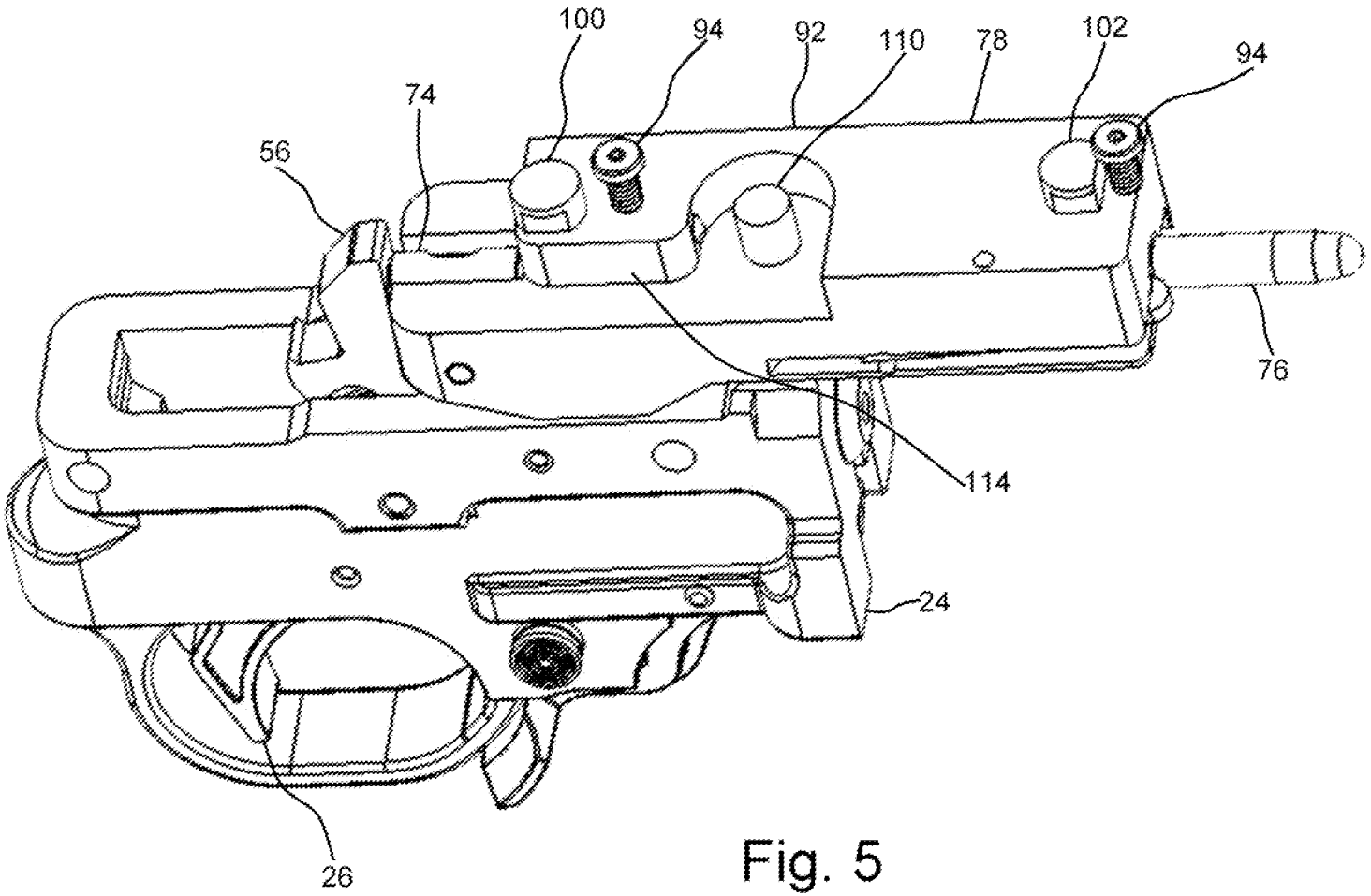
FIG. 5 is a detail view of several components of FIG. 4 with several components removed to show the underlying components.
Figure 6:
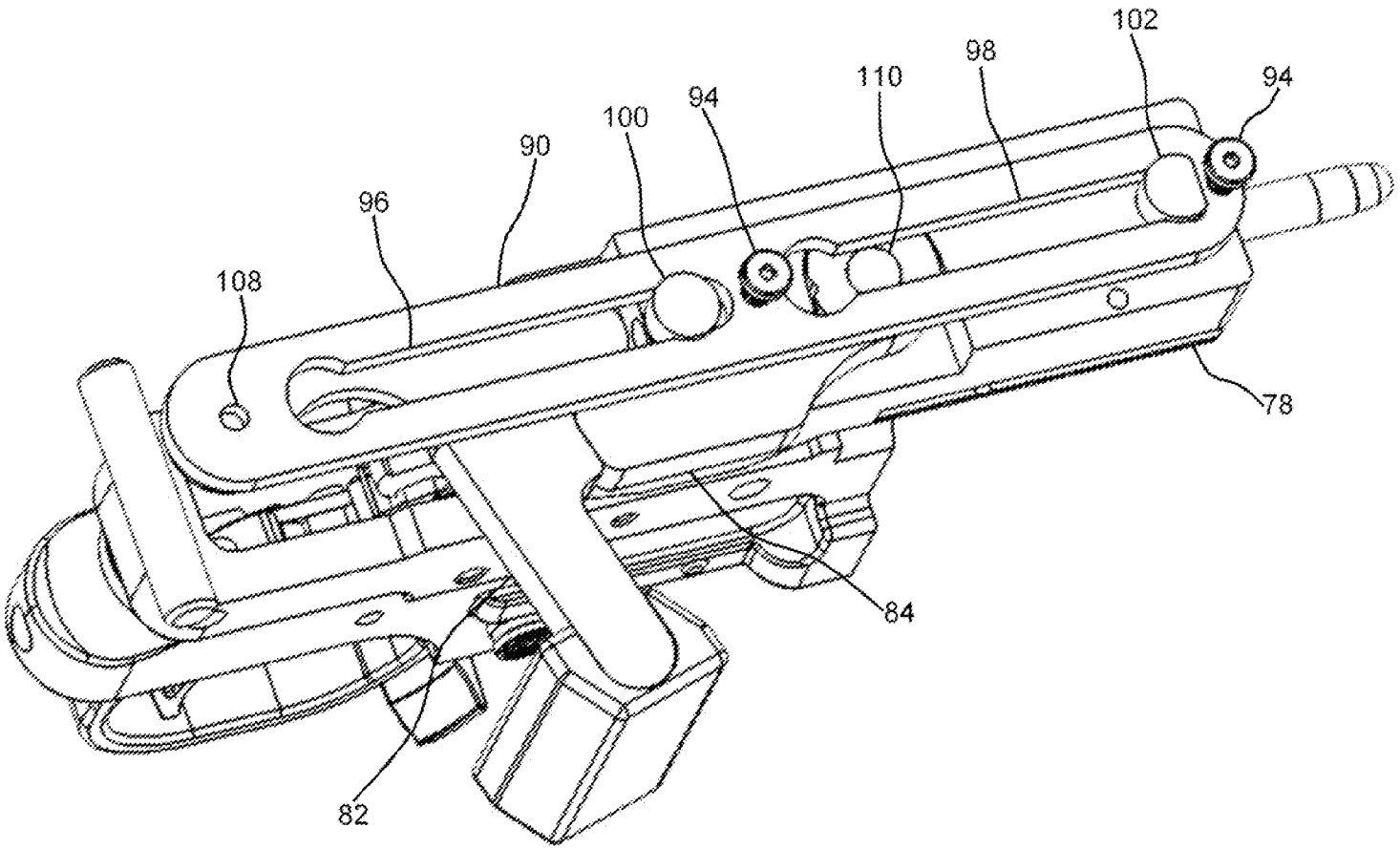
FIG. 6 is a detail view of several internal components of the embodiment of FIG. 1 with several components removed to show the underlying components.

This embodiment, utilizing a modified bolt 78 and other components, holds the modified bolt 78 in a forward position following firing, to increase the muzzle velocity of the ejected bullet and also to increase accuracy of the firearm. In one form, this is accomplished as the center of the pivot provided by extension 104 and void 106, is past the line extending between the centers of the pivot 86 and the pivot provided at surface 112. Thus, when the rifle fires, the force is not translated to movement of the levers 82/84 toward the toggle handle, but rather is directed rearwards, with a small force directed to rotate the front lever 84 towards the surface 114 of the bolt which therefore prohibits movement in that direction. This conversion results in a bolt action rifle commonly known to biathletes, where upon firing, the user reaches up with his fingers to engage the toggle handle. The toggle handle 80 is rigidly fixed to the rear lever 82, which is pivotably coupled to a front lever 84. These components can be more easily seen in FIG. 4. The rearward portion of the rear lever 82 comprises a pivot 86 fitted to a rear lever pin 88 that also engages a void 90 in a top rail 92. As can be seen in FIG. 6, the top rail 90 is attached via screws 94 or other attachment devices to the receiver 30. In one form, a plurality of channel guides 96 and 98 allow for the bolt 78 to reposition longitudinally as a plurality of studs 100 and 102 extend upwards from the bolt 78.

Looking to FIG. 3 again, an extension 104 can be seen extending downward from the rear lever 82 and engaging a void 106 in the front lever 84.

As the rear lever 82 pivots about the pivot 88 centered upon and pivotably connected to void 108 of the top rail 92, and the front lever 84 comprises a surface 112 which allows the front lever 84 to pivot about a stud or pivot pin 110, the front lever 84 and rear lever 82 operate generally in a scissor-like manner as the toggle handle 80 is repositioned outward and rearward by the user. This results in a sliding action of the bolt 78 rearward to eject the spent cartridge 76 and in one embodiment allows for insertion of a new cartridge 76 upward and forward from the clip (not shown), or in another embodiment allows for single cartridge insertion by a user/shooter.

This modification allows for the user to eject and reload a cartridge without substantial movement of their body, as a simple finger movement can function to reposition the toggle handle 80 rearward and outward and again forward and inward to eject and insert shells. This movement also re-sets the seers, trigger assembly and/or firing pin.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A retrofit assembly for a rifle, the retrofit assembly comprising:

a. a modified bolt having at least one stud extending upwardly therefrom;

b. a front lever pivotably attached at a forward end to the modified bolt;

c. a rear lever having a forward end pivotably attached to a rear portion of the front lever;

d. a toggle handle fixedly coupled to the rear lever;

e. the rear lever having a rearward end pivotably coupled to a rearward end of a top rail;

f. the top rail having a plurality of attachment points to facilitate attachment to a receiver of the rifle; and g. the top rail further comprising at least one surface defining a channel guide for linear repositioning of the stud therein.

2. The retrofit assembly as recited in claim 1, wherein the rifle is a 0.22 caliber rifle known as a Ruger® 10/22®.

3. The retrofit assembly as recited in claim 2, wherein the receiver is a stock receiver which has been modified to accept the attachment points of the top rail.

4. The retrofit assembly as recited in claim 1, wherein upon firing of a cartridge, the bolt remains stationary until the toggle handle is manually actuated.

5. A method for retrofitting a rifle to a scissor-style bolt action comprising the steps of:

a. removing the bolt of the rifle;

b. replacing the bolt with a modified bolt having at least one stud extending upwardly therefrom;

c. pivotably attaching a forward end of a front lever to the modified bolt;

d. pivotably attaching a forward end of a rear lever to a rear portion of the front lever;

e. fixedly coupling a toggle handle to the rear lever;

f. pivotably coupling a rearward end of the rear lever to a rearward end of a top rail;

g. attaching the top rail to a receiver of the rifle; and wherein h. the top rail further comprises at least one surface defining a channel guide for linear repositioning of the stud therein.

6. The method for retrofitting a rifle to a scissor-style bolt action as recited in claim 5, wherein the rifle is a 0.22 caliber rifle known as a Ruger® 10/22®.

* * * * *